United States Patent [19]

Knapp

[11] Patent Number: 4,856,115

[45] Date of Patent: Aug. 15, 1989

[54] NECKTIE WITH ADJUSTABLE CLOSURE

[76] Inventor: Eddy L. Knapp, 6131 Thorpe Springs Rd., Weatherford, Tex. 76086

[21] Appl. No.: 222,073

[22] Filed: Jul. 20, 1988

[51] Int. Cl.[4] ..... A41D 25/04

[52] U.S. Cl. ..... 2/155; 2/145

[58] Field of Search ..... 2/144, 145, 149, 150, 2/155, 156, DIG. 6; 24/49 K, 49 M, 49 R, 49 C, 50, 57, 62

[56] References Cited

U.S. PATENT DOCUMENTS

| | | | |
|---|---|---|---|
| 1,520,427 | 12/1924 | Mulroney | 2/155 |
| 2,408,455 | 10/1946 | Taborski et al. . | |
| 2,463,230 | 3/1949 | White . | |
| 2,553,437 | 5/1951 | Burke . | |
| 2,636,178 | 4/1953 | Corey . | |
| 2,821,717 | 2/1958 | Sickerott . | |
| 3,506,978 | 4/1970 | Santona | 2/150 |
| 3,737,917 | 6/1973 | Orr | 2/150 |
| 4,000,523 | 1/1977 | Woods . | |
| 4,273,130 | 6/1981 | Simpson | 2/DIG. 6 |
| 4,627,113 | 12/1986 | Lord . | |

*Primary Examiner*—Werner H. Schroeder
*Assistant Examiner*—D. Biefeld
*Attorney, Agent, or Firm*—Charles D. Gunter, Jr.

[57] ABSTRACT

An improved necktie is shown having an elongate body with a large width portion adjacent one end and having a small width portion adjacent an opposite end. A knot is located intermediate the ends of the elongate body. A neck loop extends from the knot and is divided to form first and second adjacent ends. A clasp is attached to the first adjacent end and has an opening. A flexible strip is attached to the second adjacent neck loop end. The flexible strip has a fixed end joined to the second neck loop end and has a free end adapted to loop through the clasp opening. The free has a fastener which engages the fixed end when the flexible strip is looped through the clasp opening to secure the neck loop about the neck of the wearer.

4 Claims, 1 Drawing Sheet

NECKTIE WITH ADJUSTABLE CLOSURE

BACKGROUND OF THE INVENTION

1. Field of the Invention:

This invention relates generally to decorative neck wear and specifically to preformed neck wear of the simulated four-in-hand type.

2. Description of the Prior Art:

Conventional four-in-hand fabric neckties have been worn for many decades. A number of U.S. patents show neckties of various shapes and sizes made of fabric. Although many attempts have been made to provide improvements in necktie design, a need continues to exist for a necktie which combines an attractive appearance with increased ease of use. Specifically, a need exists for a preformed necktie of the simulated four-in-hand type which combines ease of use with an attractive appearance.

SUMMARY OF THE INVENTION

The improved necktie of the invention includes a preformed knot with a neck loop provided in two pieces that are easily fastened together and unfastened to secure the neck loop around the neck of the wearer without untieing the knot. The improved necktie has an elongate body having a large width portion adjacent one end, and having a small width portion adjacent an opposite end thereof. A knot is located intermediate the ends of the elongate body. A neck loop extends from the knot and is divided to form first and second adjacent ends. A clasp is attached to the first adjacent neck loop end and is provided with a clasp opening. A flexible strip is attached to the second adjacent neck loop end. The flexible strip has a fixed end joined to the second neck loop end and has a free end adapted to loop through the clasp opening. The free end has fastening means thereon which are engageable with mating fastening means provided on the fixed end when the flexible strip is looped through the clasp opening to secure the neck loop about the neck of the wearer.

Preferably, the flexible strip has an elastic region located between the fixed end and the free end. The elastic region is selectively positioned between the fixed end and the free end of the flexible strip so as to form an engagement loop for engaging the clasp opening whereby movement of the wearer's neck causes the elastic region to stretch and contract respectively, to maintain the necktie snugly about the neck of the wearer. The fastening means on the free end and fixed end of the flexible strip can conveniently comprise hook and loop Velcro fastening materials.

Additional objects, features and advantages will be apparent in the written description which follows.

BRIEF DESCRIPTION OF THE DRAWING

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
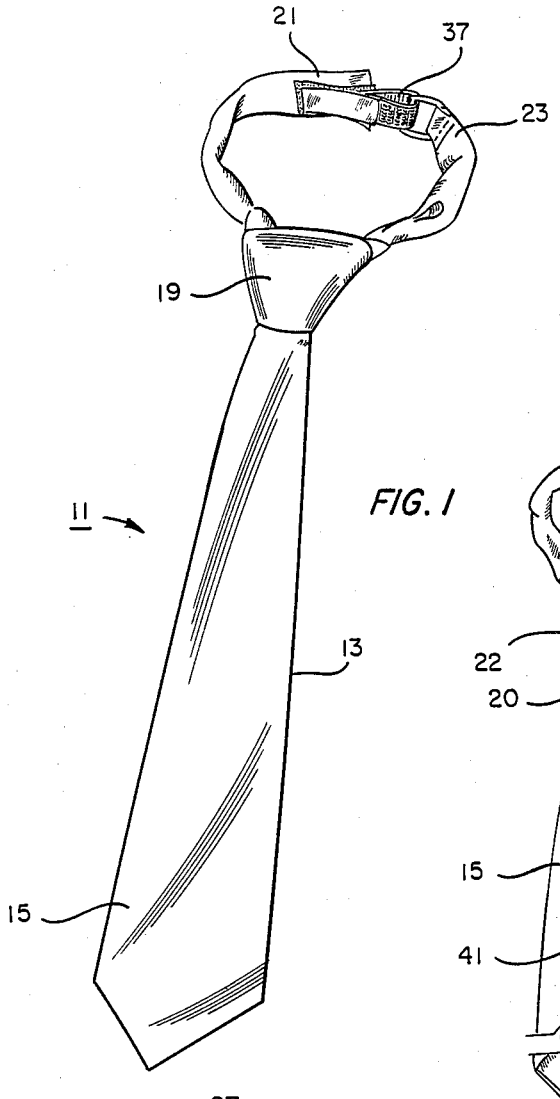
FIG. 1 is a perspective view of the front of the improved necktie with the necktie closure of the invention.

FIG. 1 shows a necktie, designated generally as 11, embodying the necktie closure of the invention. The tie 11 is a traditional four-in-hand type including an elongate body 13, having a large Width portion 15 adjacent one end thereof, and having a small width portion 17 (FIG. 3) adjacent an opposite end thereof. A preformed knot 19 is located intermediate the ends of the elongate body 13. A neck loop extends from the knot 19 and is divided to form first and second adjacent ends 21, 23.

Knot 19 is generally known as a "windsor" knot and is formed by taking the large width portion 15 along its tapered extent and wrapping it around the smaller width portion 17, and then bringing it up underneath the tie and down through the loop to form a tubular opening or sleeve 20 and face 22 for the tie.

Figure 2:
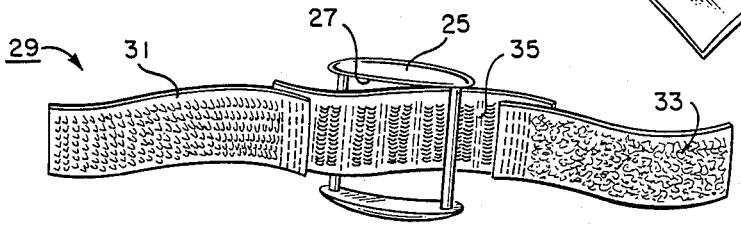
FIG. 2 is an isolated view of the improved necktie closure which is adapted to be used with the necktie of FIG. 1.

FIG. 2 shows the improved necktie closure used with the necktie of FIG. 1. The closure includes a clasp 25 having a clasp opening 27 therein. The clasp is preferably a rigid ring or buckle, as shown in FIG. 2. The clasp 25 is attached to a first adjacent neck loop end 23 in use.

The closure also includes a flexible strip 29 which is attached to a second adjacent neck loop end 21. The flexible strip 29 includes a fixed end 31 joined to the second adjacent neck loop end 21 and has a free end 33 which is adapted to loop through the clasp opening 27, as shown in FIG. 1. The free end 33 has a fastening means thereon which is engageable with mating fastening means provided on the fixed end 31 when the flexible strip 29 is looped through the clasp opening 27 to secure the neck loop about the neck of the wearer. The preferred fastening means comprise "Velcro" hook and loop materials respectively, provided on the fixed end 31 and free end 33. As is know in the art, the "Velcro" fasteners are reuseable fastening materials having soft pliable loops on one portion and the other mating portion having a plurality of hook devices. The materials are fastened by bringing the hook and loop fasteners together and will adhere until desired to unfasten the materials. They may then be readily pulled apart. Other forms of fasteners may be used if desired.

It will be noted that the flexible strip 29 includes an elastic region 35 which is located intermediate the fixed end 31 and free end 33. The elastic region is selectively positioned between the fixed end 31 and free end 33 of the flexible strip so as to form an engagement loop (37 in FIG. 1) for engaging the clasp opening 27, whereby movement of the wearer's neck causes the elastic region to stretch and contract, respectively, to maintain the necktie snugly about the neck of the user.

Figure 3:
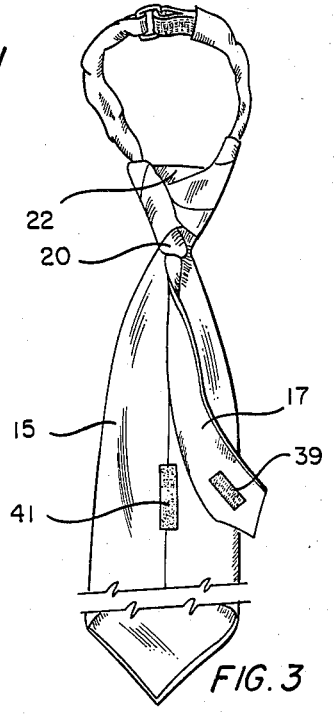
FIG. 3 is a perspective view of the back of the necktie of FIG. 1 with the neck loop portions engaged by the improved closure of the invention.

As shown in FIG. 3, the small width portion 17 of the elongate body can be provided with fastening means, such as Velcro material 39, for engaging a fastening region 41 provided on the interior of the large width portion 15. In this embodiment of the invention, the small width portion of the tie extends through the tubular opening 20 and is relatively slidable in the tubular opening to adjust the neck loop to fit the neck of a wearer. This allows a wide range of neck sizes to be accommodated by a single tie.

Alternatively, the fastening means 39, 41 can be omitted, and the small width portion 17 can be sewn to the underside of the large width portion 15. This prevents the small width portion 17 from sliding within the sleeve 20 and requires that all neck size adjustment be performed by the improved closure 29. In this embodiment, the necktie 11 would be provided in a variety of neck sizes with fine adjustment being achieved through the improved closure 29.

An invention has been provided with several advantages. The improved necktie of the invention provides increased ease of use while maintaining a realistic and pleasing appearance. It is not apparent to a viewer that the necktie is provided in a preformed style. The improved closure provides a snug fit for the necktie about the wearer's neck and accommodates neck movement, due to its elastic nature, maintaining the snug fit about the wearer's neck at all times.

While the invention has been shown in only two of its forms, it is not thus limited but is susceptible to various changes and modifications without departing from the spirit thereof.

What is claimed is:

1. An improved necktie, comprising:

an elongate body having a large width portion adjacent one end and having a small width portion adjacent an opposite end thereof;

a knot located intermediate the ends of the elongate body;

a neck loop extending from the knot, the neck loop being divided to form first and second adjacent ends;

a clasp attached to the first adjacent neck loop end the clasp having an opening therein; and a flexible strip formed entirely of fabric portions attached to the second adjacent neck loop end, the flexible strip having a fixed end joined to the second neck loop end and a free end adapted to loop through the clasp opening, the free end having a fastening means thereon engageable with mating fastening means provided on the fixed end when the flexible strip is looped through the clasp opening to secure the neck about the neck of the wearer, the flexible strip having an elastic region located between the fixed end and the free end.

2. The improved necktie of claim 1, wherein the fastening means on the free end and fixed end of the flexible strip are made-up of hook and loop Velcro fastening materials, respectively.

3. The improved necktie of claim 2, wherein the elastic region is selectively positioned between the fixed end and free end of the flexible strip so as to form an engagement loop for engaging the clasp opening, whereby movement of the wearer's neck causes the elastic region to stretch and contract respectively, to maintain the necktie snugly about the neck of the wearer.

4. An improved necktie closure adapted to be used with a necktie of the type having an elongate body having a large width portion adjacent one end having a small width portion adjacent an opposite end thereof, the body being provided with a permanent knot located intermediate the ends of the elongated body and with a neck loop extending from the knot, the neck loop being divided to form first and second adjacent ends, the improved closure comprising:

a clasp adapted to be attached to the first adjacent neck loop end, the clasp having an opening therein; and a flexible strip formed entirely of fabric portions and adapted to be attached to the second adjacent neck loop end, the flexible strip having a fixed end for joining the second neck loop end and a free end adapted to loop through the clasp opening, the fixed end and free end being separated by an elastic region which is selectively positioned between the fixed end and free end of the flexible strip so as to form an engagement loop for engaging the clasp opening, the free end having fastening means thereon engageable with mating fastening means provided on the fixed end when the flexible strip is looped through the clasp opening to secure the neck loop about the neck of the wearer, the fastening means on the free end and fixed end of the flexible strip being comprised of hook and loop fastening materials, respectively.

* * * * *